US011905640B2

(12) United States Patent
Xu et al.

(10) Patent No.: US 11,905,640 B2
(45) Date of Patent: Feb. 20, 2024

(54) LAUNDRY TREATING APPARATUS

(71) Applicants: QINGDAO HAIER DRUM WASHING MACHINE CO., LTD., Shandong (CN); Haier Smart Home Co., Ltd., Shandong (CN)

(72) Inventors: Yonghong Xu, Qingdao (CN); Tao Huang, Qingdao (CN); Bencai Huang, Qingdao (CN); Xueli Zhao, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 220 days.

(21) Appl. No.: 17/416,649

(22) PCT Filed: Dec. 17, 2019

(86) PCT No.: PCT/CN2019/125902

§ 371 (c)(1),
(2) Date: Jun. 21, 2021

(87) PCT Pub. No.: WO2020/125612

PCT Pub. Date: Jun. 25, 2020

(65) Prior Publication Data

US 2022/0074105 A1 Mar. 10, 2022

(30) Foreign Application Priority Data

Dec. 19, 2018 (CN) ..... 201811557254.8
Dec. 19, 2018 (CN) ..... 201811557261.8
(Continued)

(51) Int. Cl.
*D06F 39/00* (2020.01)
*D06F 39/08* (2006.01)
(Continued)

(52) U.S. Cl.
CPC ..... *D06F 39/008* (2013.01); *D06F 39/088* (2013.01); *D06F 23/02* (2013.01);
(Continued)

(58) Field of Classification Search
CPC ..... D06F 39/02; D06F 39/008; D06F 39/088; D06F 2105/42
See application file for complete search history.

(56) References Cited

U.S. PATENT DOCUMENTS

2015/0225887 A1* 8/2015 Schulze ..... D06F 39/008 8/137
2015/0299926 A1* 10/2015 Kim ..... D06F 21/02 8/137

FOREIGN PATENT DOCUMENTS

CN 204728096 U 10/2015
CN 205134025 U 4/2016
(Continued)

OTHER PUBLICATIONS

Machine translation of CN-210177180-U. (Year: 2020).*
(Continued)

*Primary Examiner* — Joseph L. Perrin
(74) *Attorney, Agent, or Firm* — Maier & Maier, PLLC

(57) ABSTRACT

A laundry treating apparatus is provided, which includes a laundry treating drum, and further includes a water supply valve, a water container member, an atomizer and a driving board. The water supply valve is connected to the atomizer by the water container member. An outlet of the atomizer is disposed toward an inner cavity of the laundry treating drum. A container structure is disposed on the water container member. The driving board is disposed in the container structure and is communicatively connected with the atomizer. The laundry treating apparatus can reduce manufacturing difficulty of a laundry treating apparatus having an
(Continued)

atomizer, such that the laundry treating apparatus can fully utilize the atomization function of the atomizer.

9 Claims, 6 Drawing Sheets

(30) Foreign Application Priority Data

| | | |
|---|---|---|
| Dec. 19, 2018 | (CN) | 201811560199.8 |
| Dec. 19, 2018 | (CN) | 201811560212.X |
| Dec. 19, 2018 | (CN) | 201811567338.X |

(51) Int. Cl.

| | |
|---|---|
| ***D06F 105/42*** | (2020.01) |
| *D06F 23/02* | (2006.01) |
| *D06F 37/20* | (2006.01) |
| *D06F 39/02* | (2006.01) |

(52) U.S. Cl.
CPC ..... *D06F 37/20* (2013.01); *D06F 39/02* (2013.01); *D06F 2105/42* (2020.02)

(56) References Cited

FOREIGN PATENT DOCUMENTS

| | | | | | |
|---|---|---|---|---|---|
| CN | 107503085 | A | | 12/2017 | |
| CN | 207933741 | U | * | 10/2018 | |
| CN | 208009075 | U | | 10/2018 | |
| CN | 209703096 | U | | 11/2019 | |
| CN | 209703097 | U | | 11/2019 | |
| CN | 209703101 | U | | 11/2019 | |
| CN | 209703103 | U | | 11/2019 | |
| CN | 210177180 | U | * | 3/2020 | ..... D06F 34/08 |
| JP | 2009247770 | A | | 10/2009 | |

OTHER PUBLICATIONS

Machine translation of CN-207933741-U. (Year: 2018).*
International Search Report dated Mar. 19, 2020 in corresponding International Application No. PCT/CN2019/125902; 8 pages.

* cited by examiner

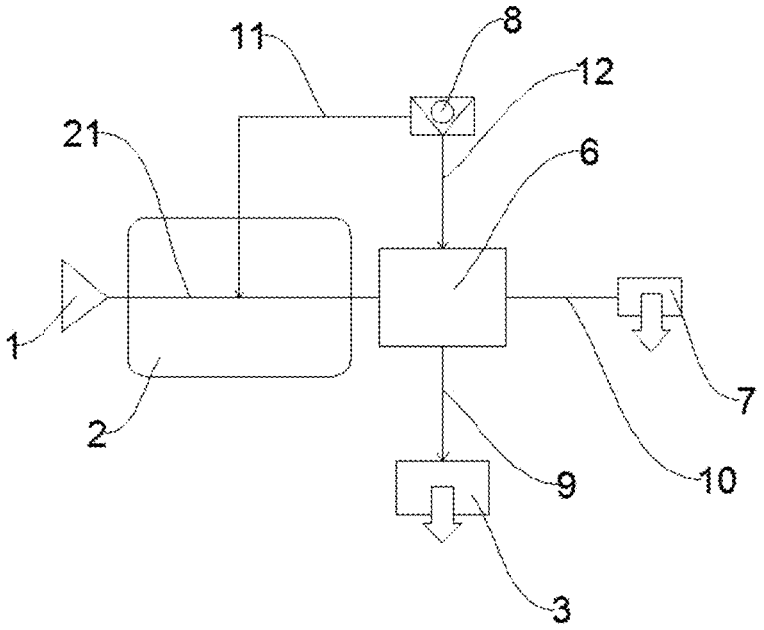
Fig.~~11~~5

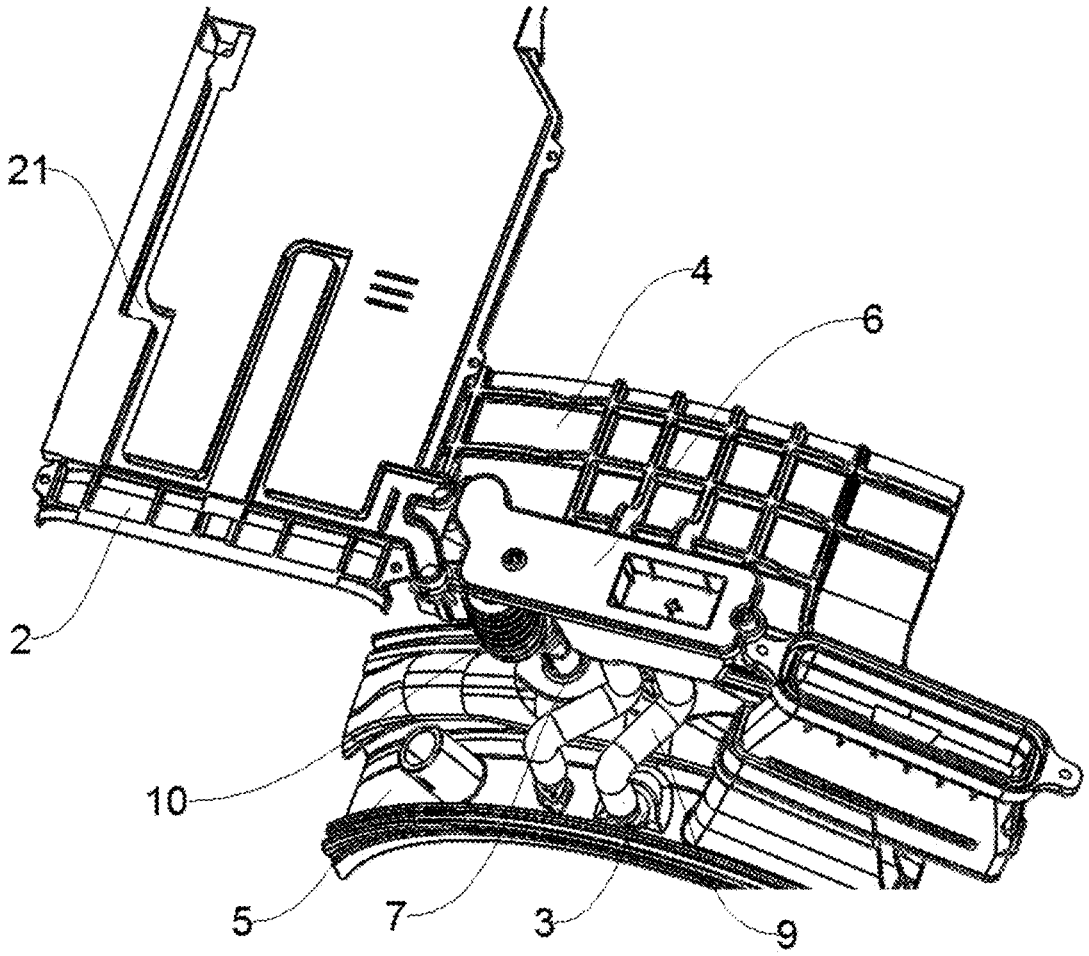
Fig.~~12~~6

LAUNDRY TREATING APPARATUS

FIELD

The present disclosure belongs to the technical field of clothing treatment, and specifically provides a clothing treatment apparatus.

BACKGROUND

A clothing treatment apparatus is an apparatus capable of washing, drying, sterilizing and/or deodorizing clothing. With the continuous improvement of production level and ongoing growth of users' needs, users have also raised higher and higher requirements on the clothing treatment apparatus.

In the prior art, taking a washing machine as an example, the clothing is generally washed by water. The washing process is accompanied by mechanical rotation, so that stains on the clothing are washed away. However, this washing method has a limitation in that if a large amount of water is injected into a washing drum at the beginning, the stains on a surface of the clothing will directly enter a lining of the clothing in a state where a washing liquid is not completely dissolved, so that more time, water amount, washing liquid and mechanical action are required for washing the clothing clean in the subsequent washing process, thus resulting in a poor washing effect. Therefore, the clothing can be washed by atomized air washing. An atomization generator is required to be provided for this kind of washing machine, and the atomization generator needs a driving board for driving. If the driving board and a control panel of the washing machine are installed together, more space of a washing machine tray will be inevitably occupied, and a relatively long wire harness is required to connect the driving board with the atomization generator, which makes it inconvenient to arrange the wire harness; therefore, the kind of washing machine with the atomization generator has significant limitations in actual production.

With the advancement of science and technology, the automation level of human life is becoming higher and higher, and for daily housework, manpower is being gradually replaced by machines. As a common household appliance in daily life, the clothing treatment apparatus has brought great convenience to people's lives. According to the washing mode, the clothing treatment apparatus can be roughly divided into a pulsator washing machine and a drum washing machine. Taking the drum washing machine as an example, the clothing is generally washed by water. The washing process is accompanied by mechanical rotation, so that stains on the clothing are washed away. However, this washing method has a limitation in that if a large amount of water is injected into the washing drum at the beginning, the stains on the surface of the clothing will directly enter the lining of the clothing in a state where the washing liquid is not completely dissolved, so that more time, water amount, washing liquid and mechanical action are required for washing the clothing clean in the subsequent washing process, thus resulting in a poor washing effect.

In order to solve the above problems, the drum washing machine is equipped with an atomization generator and a water tank for supplying water to the atomization generator. Under the atomization action of the atomization generator, the water is converted into small particles of atomized water droplets to realize a treatment of the clothing by atomized air, which improves the washing effect of the clothing and improves the user experience in use. However, the water tank of the above-mentioned drum washing machine cannot divert and block the water injected into it, and it is difficult to meet the user's use demand of supplying water to different apparatuses successively, which greatly affects the user experience in use.

With the advancement of science and technology, the automation level of human life is becoming higher and higher, and for daily housework, manpower is being gradually replaced by machines. As a common household appliance in daily life, the clothing treatment apparatus has brought great convenience to people's lives. According to the washing mode, the clothing treatment apparatus can be roughly divided into a pulsator washing machine and a drum washing machine. Taking the drum washing machine as an example, the clothing is generally washed by water. The washing process is accompanied by mechanical rotation, so that stains on the clothing are washed away. However, this washing method has a limitation in that if a large amount of water is injected into the washing drum at the beginning, the stains on the surface of the clothing will directly enter the lining of the clothing in a state where the washing liquid is not completely dissolved, so that more time, water amount, washing liquid and mechanical action are required for washing the clothing clean in the subsequent washing process, thus resulting in a poor washing effect.

In order to solve the above problems, the drum washing machine is equipped with an atomization generator and a water tank for supplying water to the atomization generator. Under the atomization action of the atomization generator, the water is converted into small particles of atomized water droplets to realize a treatment of the clothing by atomized air, which improves the washing effect of the clothing and improves the user experience in use. However, the function of the water tank of the above-mentioned drum washing machine is single, which can only meet the demand of supplying water to the atomization generator, and cannot meet the user's other use demands, which greatly affects the user's experience in use.

With the advancement of science and technology, the automation level of human life is becoming higher and higher, and for daily housework, manpower is being gradually replaced by machines. As a common household appliance in daily life, the clothing treatment apparatus has brought great convenience to people's lives. According to the washing mode, the clothing treatment apparatus can be roughly divided into a pulsator washing machine and a drum washing machine. Taking the drum washing machine as an example, the clothing is generally washed by water. The washing process is accompanied by mechanical rotation, so that stains on the clothing are washed away. However, this washing method has a limitation in that if a large amount of water is injected into the washing drum at the beginning, the stains on the surface of the clothing will directly enter the lining of the clothing in a state where the washing liquid is not completely dissolved, so that more time, water amount, washing liquid and mechanical action are required for washing the clothing clean in the subsequent washing process, thus resulting in a poor washing effect.

In order to solve the above problems, the drum washing machine is equipped with an atomization generator and a water tank for supplying water to the atomization generator. Under the atomization action of the atomization generator, the water is converted into small particles of atomized water droplets to realize a treatment of the clothing by atomized air, which improves the washing effect of the clothing and improves the user experience in use. However, after the atomization is completed in the water tank of the above-mentioned drum washing machine, a small amount of water will remain in the water tank. If this part of water is not discharged, bacteria will grow in the water tank, which will affect the hygienic security of the drum washing machine and greatly affect the user's experience in use.

A clothing treatment apparatus is an apparatus capable of washing, drying, sterilizing and/or deodorizing clothing. With the continuous improvement of production level and ongoing growth of users' needs, users have also raised higher and higher requirements on the clothing treatment apparatus.

In the prior art, taking the washing machine as an example, the clothing is generally washed by water. The washing process is accompanied by mechanical rotation, so that stains on the clothing are washed away. However, this washing method has a limitation in that if a large amount of water is injected into the washing drum at the beginning, the stains on the surface of the clothing will directly enter the lining of the clothing in a state where the washing liquid is not completely dissolved, so that more time, water amount, washing liquid and mechanical action are required for washing the clothing clean in the subsequent washing process, thus resulting in a poor washing effect. In existing clothing treatment apparatuses, other functions are often added on the basis of the washing machine, such as adding a drying function to become a washing-drying integrated machine, etc. Such an improvement does not significantly improve the washing effect of the washing machine. Moreover, current washing machines still cannot achieve in-depth treatment of clothing made of special materials, such as cashmere, wool and other materials. If the traditional washing by water is used, it is highly possible that fiber structures of the clothing will be damaged, which will cause a very big limitation on an applicable range of the clothing of the washing machine.

Accordingly, there is a need for a new clothing treatment apparatus in the art to solve the above problems.

SUMMARY

In order to solve the above problem in the prior art, that is, in order to solve the problem that the production of the clothing treatment apparatus has major limitations if the existing clothing treatment apparatus is equipped with an atomization generator, the present disclosure provides a clothing treatment apparatus, the clothing treatment apparatus includes a clothing treatment drum, and the clothing treatment apparatus also includes a water supply valve, a water-containing member, an atomization generator and a driving board; in which the water supply valve is connected to the atomization generator through the water-containing member, an outlet of the atomization generator is arranged facing an inner cavity of the clothing treatment drum, the water-containing member is provided with an accommodating structure, the driving board is arranged in the accommodating structure, and the driving board is in communication connection with the atomization generator.

In a preferred technical solution of the above clothing treatment apparatus, the accommodating structure is a recess formed on an outer surface of the water-containing member, and the driving board is arranged in the recess.

In a preferred technical solution of the above clothing treatment apparatus, at least one guide structure is arranged on an inner side wall of the recess, and the guide structure is arranged to be able to guide the driving board to an installation position in the recess.

In a preferred technical solution of the above clothing treatment apparatus, the guide structure is a guide rib, and a thickness of the guide rib gradually increases in an installation direction of the driving board.

In a preferred technical solution of the above clothing treatment apparatus, at least one abutment rib is further arranged in the recess, the abutment ribs correspond to the guide ribs in a one-to-one correspondence, and the abutment ribs are arranged between the guide ribs and an inner bottom wall of the recess; in an assembled state, the abutment ribs abut against an outer edge of the driving board.

In a preferred technical solution of the above clothing treatment apparatus, the abutment rib and the guide rib are provided as one piece.

In a preferred technical solution of the above clothing treatment apparatus, at least one support rib is further arranged in the recess, the support ribs correspond to the abutment ribs in a one-to-one correspondence, and the support ribs are arranged between the abutment ribs and the inner bottom wall of the recess; in the assembled state, the driving board is supported on the support ribs.

In a preferred technical solution of the above clothing treatment apparatus, the support rib and the abutment rib are provided as one piece.

In a preferred technical solution of the above clothing treatment apparatus, the clothing treatment apparatus further includes a dispensing device, the dispensing device includes a water delivery channel, and the water supply valve is connected to the water-containing member through the water delivery channel; the water delivery channel is provided with a one-way check structure, and the one-way check structure is arranged to be isolated from the atmosphere when the water supply valve is opened and to communicate with the atmosphere when the water supply valve is closed.

In a preferred technical solution of the above clothing treatment apparatus, the clothing treatment apparatus is a drum washing machine, and the clothing treatment drum is a drum of the drum washing machine; the drum washing machine further includes a window gasket connected to the drum, and the atomization generator is arranged on the window gasket.

Those skilled in the art can understand that in the preferred technical solutions of the present disclosure, by arranging the driving board in the accommodating structure on the water-containing member, that is, by installing the driving board and the water-containing member together, other space of the clothing treatment apparatus will not be occupied, that is, there is no need to install the driving board at the tray of the clothing treatment apparatus, which would otherwise occupy the space of the tray; moreover, a relative distance between the driving board and the atomization generator is reduced, which facilitates connecting the driving board and the atomization generator through a very short wire harness to avoid the cumbersome spatial arrangement of the wire harness. Even if the driving board and the atomization generator are connected by Bluetooth or other wireless methods, it can also facilitate the driving board to transmit control signals to the atomization generator, preventing other electronic components from producing electromagnetic interference to the transmitted signals. With such an arrangement, the manufacturing difficulty of the clothing treatment apparatus with the atomization generator is reduced, so that the clothing treatment apparatus can make full use of the atomization function of the atomization generator. For example, before washing by water, the clothing can be moistened first by atomized water droplets, so that the stains on the surface of the clothing are removed first, preventing the stains on the surface of the clothing from entering the lining of the clothing. Therefore, less time, water amount, washing liquid and mechanical action can be used to wash the clothing clean in the subsequent washing process so that the washing effect on the clothing is improved and the clothing treatment apparatus is more energy-saving. In addition, the use of this atomized air washing method can treat clothing of special materials such as cashmere, wool, etc., which not only can make the surface of the clothing of this material smoother and softer, but also can quickly remove stains on the clothing without damaging the fiber structures of the clothing, thereby increasing the applicable range of the clothing of the clothing treatment apparatus and further improving the user experience.

Further, the driving board is arranged in the recess formed on the outer surface of the water-containing member. Therefore, an outer contour of the water-containing member still has a relatively regular shape, so that the space of the water-containing member is fully utilized without affecting the function of the water-containing member; moreover, the recess has a certain clamping and limiting effect on the driving board, so that the driving board can be firmly and stably installed in the recess, which facilitates the assembly of the driving board and improves the assembly efficiency.

Further, by providing a guide structure on the inner wall of the recess, the driving board can be guided to be installed at the installation position of the recess, so that the driving board can be accurately installed in place, thereby further improving the assembly efficiency of the driving board.

Further, the guide rib structure with a gradually changing thickness can guide the driving board to be installed at the installation position of the recess. Specifically, the guide rib with the gradually changing thickness enables the driving board to have a certain fault tolerant space at the beginning of installing the driving board. That is, when users, production technicians or maintenance personnel install the driving board, they can roughly align the driving board from above the guide rib, and then press the driving board directly into the recess by pressing; and in the process of pressing, the guide rib can automatically correct the position of the driving board, so that the driving board can be accurately installed at the corresponding position of the recess, thereby improving assembly efficiency and assembly accuracy.

Further, the abutment rib can abut against the outer edge of the driving board, so that the driving board can be stably fixed in the recess, which improves a connection strength between the driving board and the recess, and ensures that the driving board will not be detached from the recess during the operation of the clothing treatment apparatus.

Further, the driving board can be supported by the support ribs, thereby improving the support stability of the driving board and further improving the supporting effect on the driving board.

Further, the one-way check structure enables the clothing treatment apparatus to perform atomized air washing of the clothing according to the principle of atmospheric communication when the water supply valve is closed, so that the atomization generator can smoothly generate atomized water droplets, which ensures the smooth operation of atomized air washing and further improves the user experience.

Second Technical Solution

In order to solve the above problems in the prior art, that is, in order to solve the problem that a water-containing assembly of the existing clothing treatment apparatus cannot divert and block the water injected into it and it is difficult to meet the user's use demand of supplying water to different apparatuses successively, the present disclosure provides a clothing treatment apparatus, and the clothing treatment apparatus includes a cabinet, and a water-containing assembly, a sprinkling mechanism and an atomization generator that are arranged in the cabinet; in which the water-containing assembly includes a water tank and a water diverting and blocking member arranged in the water tank, the water tank is connected to the sprinkling mechanism through a first delivery pipeline, the water tank is connected to the atomization generator through a second delivery pipeline, and the water diverting and blocking member is configured to change a sequence of the water injected into the water tank flowing to the atomization generator and flowing to the sprinkling mechanism.

In a preferred technical solution of the above clothing treatment apparatus, the water tank includes a first water-containing member and a second water-containing member that communicate with each other, an outlet of the first water-containing member is connected to the sprinkling mechanism through the first delivery pipeline, and an outlet of the second water-containing member is connected to the atomization generator through the second delivery pipeline.

In a preferred technical solution of the above clothing treatment apparatus, the water diverting and blocking member includes a water diverting and blocking rib arranged in the first water-containing member, and the water diverting and blocking rib divides an internal space of the first water-containing member into a first chamber and a second chamber; an inlet of the first water-containing member is arranged in the first chamber, and the outlet of the first water-containing member is arranged in the second chamber; the water diverting and blocking rib is arranged such that: when the water begins to be injected into the water tank, the water diverting and blocking rib enables all the water flowing through the first chamber to flow into the second water-containing member; and when the second water-containing member is fully filled with water, the water flowing through the first chamber overflows the water diverting and blocking rib, flows into the second chamber, and flows to the sprinkling mechanism through the first delivery pipeline.

In a preferred technical solution of the above clothing treatment apparatus, a height of a bottom of the first water-containing member is larger than a height of a bottom of the second water-containing member.

In a preferred technical solution of the above clothing treatment apparatus, the water-containing assembly further includes a cover and a positioning member, and the cover is placed onto a top of the cabinet through the positioning member.

In a preferred technical solution of the above clothing treatment apparatus, the positioning member includes a positioning post or a positioning hole provided in the first water-containing member and a positioning hole or a positioning post provided on the cover, and the positioning post or the positioning hole in the first water-containing member can match with the positioning hole or the positioning post on the cover.

In a preferred technical solution of the above clothing treatment apparatus, the clothing treatment apparatus further includes an outer cylinder arranged in the cabinet and an inner cylinder rotatably accommodated in the outer cylinder, the cabinet is provided with a clothing inlet, and a window gasket is arranged between the clothing inlet and the outer cylinder; the sprinkling mechanism includes a sprinkling head arranged on the window gasket, the outlet of the first water-containing member is connected to the sprinkling head through the first delivery pipeline, and the sprinkling head is configured to spray water into the inner cylinder.

In a preferred technical solution of the above clothing treatment apparatus, the clothing treatment apparatus further includes a water supply valve, a water delivery channel and a one-way check structure that are arranged in the cabinet; the water supply valve is connected to a water inlet end of the water delivery channel, and a water outlet end of the water delivery channel is connected to the atomization generator through the first water-containing member and the second water-containing member; the one-way check structure is connected to the water delivery channel and the first water-containing member respectively, and the one-way check structure is arranged to be isolated from the atmosphere when the water supply valve is opened and to communicate with the atmosphere when the water supply valve is closed.

In a preferred technical solution of the above clothing treatment apparatus, the one-way check structure is a one-way check valve.

In a preferred technical solution of the above clothing treatment apparatus, an outlet of the atomization generator is obliquely arranged.

Those skilled in the art can understand that in the preferred technical solutions of the present disclosure, the drum washing machine includes a cabinet, and a water-containing assembly, a sprinkling mechanism and an atomization generator that are arranged in the cabinet. As compared with the existing technical solution in which the water-containing assembly cannot divert the water injected into it, the water-containing assembly of the present disclosure includes a water tank and a water diverting and blocking member arranged in the water tank, the water tank is connected to the sprinkling mechanism through a first delivery pipeline, the water tank is connected to the atomization generator through a second delivery pipeline, and the water diverting and blocking member is configured to change a sequence of the water injected into the water tank flowing to the atomization generator and flowing to the sprinkling mechanism. For example, water is first supplied to the atomization generator, and then supplied to the sprinkling mechanism, or water is first supplied to the sprinkling mechanism, and then supplied to the atomization generator, so as to meet the requirement of users to choose the washing sequence of atomized air washing and sprinkling washing according to different clothing, which can better wash the clothing, avoid damage to the fiber structures of the clothing, improve the applicable range of the clothing of the drum washing machine, and further improve the user experience.

Further, the first water-containing member is provided therein with a water diverting and blocking rib. When water begins to be injected into the water tank, the water diverting and blocking rib enables all the water flowing through the first chamber to flow into the second water-containing member. The water flowing into the second water-containing member is sprayed from the atomization generator, and is converted into small particles of atomized water droplets under the atomization action of the atomization generator. The atomized water droplets can first moisten the clothing so that stains on the surface of clothing are removed first to prevent the stains on the surface of the clothing from entering the lining of the clothing. When the second water-containing member is completely filled with water, the water flowing through the first chamber overflows the water diverting and blocking rib, flows into the second chamber, and flows to the sprinkling head through the first delivery pipeline. The sprinkling head sprays water into the inner cylinder, so that less time, water amount, washing liquid and mechanical action can be used to wash the clothing clean in the subsequent washing process, thereby improving the washing effect on the clothing and making the drum washing machine more energy-saving.

Further, the drum washing machine includes a water supply valve, a water delivery channel and a one-way check structure that are arranged in the cabinet. By connecting the one-way check structure with the water delivery channel, the first water-containing member and the second water-containing member, when the water supply valve is opened, water can be injected into the water delivery channel, the first water-containing member and the second water-containing member, and then when the water supply valve is closed, the one-way check structure communicates with the atmosphere so that the water in the water delivery channel, the first water-containing member and the second water-containing member is sprayed from the atomization generator. The water is converted into small particles of atomized water droplets under the atomization action of the atomization generator, thereby realizing a tender treatment of the clothing by atomized air. The use of this atomized air washing method can treat clothing of special materials such as cashmere, wool, etc., which not only can make the surface of the clothing of this material smoother and softer, but also can quickly remove stains on the clothing without damaging the fiber structures of the clothing, thereby increasing the applicable range of the clothing of the drum washing machine and further improving the user experience.

Third Technical Solution

In order to solve the above problem in the prior art, that is, in order to solve the problem that the function of a water-containing assembly of the existing clothing treatment apparatus is single and it is difficult to meet the various requirements of users, the present disclosure provides a clothing treatment apparatus, and the treatment apparatus includes a cabinet, and a water-containing assembly, a sprinkling assembly and an atomization generator that are arranged in the cabinet; in which the water-containing assembly includes a water tank and a plurality of delivery pipelines, the water tank is connected to the atomization generator through one of the delivery pipelines, and the atomization generator is configured to perform atomized washing on the clothing; the water tank is connected to the sprinkling assembly through the rest of the delivery pipelines, and the sprinkling assembly is configured to perform sprinkling washing on the clothing.

In a preferred technical solution of the above clothing treatment apparatus, the water tank includes a first water-containing member and a second water-containing member that communicate with each other, and the plurality of delivery pipelines include a first delivery pipeline, a second delivery pipeline, and a third delivery pipeline; in which an outlet of the first water-containing member is connected to the sprinkling assembly through the first delivery pipeline, a first outlet of the second water-containing member is connected to the atomization generator through the second delivery pipeline, and a second outlet of the second water-containing member is connected to the sprinkling assembly through the third delivery pipeline.

In a preferred technical solution of the above clothing treatment apparatus, the clothing treatment apparatus further includes an outer cylinder arranged in the cabinet and an inner cylinder rotatably accommodated in the outer cylinder, the cabinet is provided with a clothing inlet, and a window gasket is arranged between the clothing inlet and the outer cylinder; the sprinkling assembly includes a first sprinkling head arranged on the window gasket, the outlet of the first water-containing member is connected to the first sprinkling head through the first delivery pipeline, and the first sprinkling head is configured to spray water into the inner cylinder.

In a preferred technical solution of the above clothing treatment apparatus, the clothing treatment apparatus further includes a door pivotally connected to the cabinet, and the door is provided with a viewing window; the sprinkling assembly further includes a second sprinkling head arranged on the window gasket, the second outlet of the second water-containing member is connected to the second sprinkling head through the third delivery pipeline, and the second sprinkling head is configured to spray water onto the viewing window.

In a preferred technical solution of the above clothing treatment apparatus, the clothing treatment apparatus further includes a water supply valve, a water delivery channel and a one-way check structure that are arranged in the cabinet; the water supply valve is connected to a water inlet end of the water delivery channel, and a water outlet end of the water delivery channel is connected to the atomization generator through the first water-containing member and the second water-containing member; the one-way check structure is connected to the water delivery channel and the first water-containing member respectively, and the one-way check structure is arranged to be isolated from the atmosphere when the water supply valve is opened and to communicate with the atmosphere when the water supply valve is closed.

In a preferred technical solution of the above clothing treatment apparatus, the one-way check structure is a one-way check valve.

In a preferred technical solution of the above clothing treatment apparatus, the first water-containing member is provided therein with a water diverting and blocking rib, and the water diverting and blocking rib divides an internal space of the first water-containing member into a first chamber and a second chamber; an inlet of the first water-containing member is arranged in the first chamber, and the outlet of the first water-containing member is arranged in the second chamber; the water diverting and blocking rib is arranged such that: when the water begins to be injected into the water tank, the water diverting and blocking rib enables all the water flowing through the first chamber to flow into the second water-containing member; and when the second water-containing member is fully filled with water, the water flowing through the first chamber overflows the water diverting and blocking rib, flows into the second chamber, and flows to the first sprinkling head through the first delivery pipeline.

In a preferred technical solution of the above clothing treatment apparatus, a height of a bottom of the first water-containing member is larger than a height of a bottom of the second water-containing member.

In a preferred technical solution of the above clothing treatment apparatus, the water tank further includes a siphon member, which is connected to the second sprinkling head through the third delivery pipeline, and which is configured to suck out water in the second water-containing member by siphoning.

In a preferred technical solution of the above clothing treatment apparatus, the water-containing assembly further includes a cover arranged above the water tank; the siphon member includes a siphon cap arranged on the cover and a siphon tube arranged in the second water-containing member, and the siphon tube communicates with the second outlet of the second water-containing member; when the cover is closed with the water tank, the siphon cap can be sleeved over the siphon tube, a siphon channel is formed between the siphon cap and the siphon tube, and the water in the second water-containing member can flow to the second sprinkling head through the siphon channel and the third delivery pipeline.

Those skilled in the art can understand that in the preferred technical solutions of the present disclosure, the drum washing machine includes a cabinet and a water-containing assembly, a sprinkling assembly and an atomization generator that are arranged in the cabinet. As compared with the existing technical solution in which the water tank supplies water to the atomization generator, the water-containing assembly of the present disclosure includes a water tank and a plurality of delivery pipelines. The water tank is connected to the atomization generator through one of the delivery pipelines, and the water tank is connected to the sprinkling assembly through the rest of the delivery pipelines, so that not only the atomization generator can be supplied with water, but also the sprinkling assembly can be supplied with water. Therefore, the drum washing machine has two clothing washing modes, i.e., atomized air washing and sprinkling washing, so that users can flexibly select the corresponding washing method according to their own needs to meet various requirements of users and improve the user experience.

Further, the drum washing machine includes a water supply valve, a water delivery channel and a one-way check structure that are arranged in the cabinet. By connecting the one-way check structure with the water delivery channel, the first water-containing member and the second water-containing member, when the water supply valve is opened, water can be injected into the water delivery channel, the first water-containing member and the second water-containing member, and then when the water supply valve is closed, the one-way check structure communicates with the atmosphere so that the water in the water delivery channel, the first water-containing member and the second water-containing member is sprayed from the atomization generator. The water is converted into small particles of atomized water droplets under the atomization action of the atomization generator, thereby realizing a tender treatment of the clothing by atomized air. The use of this atomized air washing method can treat clothing of special materials such as cashmere, wool, etc., which not only can make the surface of the clothing of this material smoother and softer, but also can quickly remove stains on the clothing without damaging the fiber structures of the clothing, thereby increasing the applicable range of the clothing of the drum washing machine and further improving the user experience.

Further, the first water-containing member is provided therein with a water diverting and blocking rib. When water begins to be injected into the water tank, the water diverting and blocking rib enables all the water flowing through the first chamber to flow into the second water-containing member. The water flowing into the second water-containing member is sprayed from the atomization generator, and is converted into small particles of atomized water droplets under the atomization action of the atomization generator. The atomized water droplets can first moisten the clothing so that stains on the surface of clothing are removed first to prevent the stains on the surface of the clothing from entering the lining of the clothing. When the second water-containing member is completely filled with water, the water flowing through the first chamber overflows the water diverting and blocking rib, flows into the second chamber, and flows to the first sprinkling head through the first delivery pipeline. The first sprinkling head sprays water into the inner cylinder, so that less time, water amount, washing liquid and mechanical action can be used to wash the clothing clean in the subsequent washing process, thereby improving the washing effect on the clothing and making the drum washing machine more energy-saving.

Further, the water tank further includes a siphon member, the siphon member is connected to the second sprinkling head through the third delivery pipeline, and when the second water-containing member is completely filled with water, the siphon member can suck out all the water in the second water-containing member by siphoning, so that all the water in the second water-containing member is emptied, which prevents water from remaining in the second water-containing member, thereby preventing the second water-containing member from becoming moldy, deteriorating, and breeding bacteria, and improving the hygienic security of the drum washing machine.

Fourth Technical Solution

In order to solve the above problem in the prior art, that is, in order to solve the problem that the residual water in the water-containing assembly of the existing clothing treatment apparatus cannot be discharged, the present disclosure provides a clothing treatment apparatus, and the clothing treatment apparatus includes a housing, and a water-containing assembly and a sprinkling assembly that are arranged in the housing; the water-containing assembly includes a water tank and a siphon member arranged in the water tank, the siphon member is connected to the sprinkling assembly through a first delivery pipeline, the siphon member is configured to suck out water in the water tank by siphoning, and the sprinkling assembly is configured to perform sprinkling washing on the clothing.

In a preferred technical solution of the above clothing treatment apparatus, the water tank includes a cabinet and a cover arranged above the cabinet; the siphon member includes a siphon cap arranged on the cover and a siphon tube arranged in the cabinet, and the siphon tube communicates with the first delivery pipeline through a first outlet of the cabinet; when the cover is closed with the cabinet, the siphon cap can be sleeved over the siphon tube, a siphon channel is formed between the siphon cap and the siphon tube, and the water in the cabinet can flow to the sprinkling assembly through the siphon channel and the first delivery pipeline.

In a preferred technical solution of the above clothing treatment apparatus, the clothing treatment apparatus further includes an outer cylinder arranged in the housing and an inner cylinder rotatably accommodated in the outer cylinder, the housing is provided with a clothing inlet, and a window gasket is arranged between the clothing inlet and the outer cylinder; the sprinkling assembly includes a first sprinkling head arranged on the window gasket, a second outlet of the cabinet is connected to the first sprinkling head through a second delivery pipeline, and the first sprinkling head is configured to spray water into the inner cylinder.

In a preferred technical solution of the above clothing treatment apparatus, the clothing treatment apparatus further includes a door pivotally connected to the housing, and the door is provided with a viewing window; the sprinkling assembly further includes a second sprinkling head arranged on the window gasket, the first outlet of the cabinet is connected to the second sprinkling head through the first delivery pipeline, and the second sprinkling head is configured to spray water onto the viewing window.

In a preferred technical solution of the above clothing treatment apparatus, a height of the second outlet of the cabinet is larger than a height of the first outlet of the cabinet.

In a preferred technical solution of the above clothing treatment apparatus, the clothing treatment apparatus further includes an atomization generator arranged on the window gasket; a third outlet of the cabinet is connected to the atomization generator through a third delivery pipeline, and the atomization generator is configured to perform atomized washing on the clothing.

In a preferred technical solution of the above clothing treatment apparatus, the clothing treatment apparatus further includes a water supply valve, a water delivery channel and a one-way check structure that are arranged in the housing; the water supply valve is connected to a water inlet end of the water delivery channel, a water outlet end of the water delivery channel is connected to the atomization generator through the water tank, the one-way check structure is connected to the water delivery channel and the water tank respectively, and the one-way check structure is arranged to be isolated from the atmosphere when the water supply valve is opened and to communicate with the atmosphere when the water supply valve is closed.

In a preferred technical solution of the above clothing treatment apparatus, the one-way check structure is a one-way check valve.

In a preferred technical solution of the above clothing treatment apparatus, the water tank further includes a positioning member, and the cover is placed onto a top of the cabinet through the positioning member.

In a preferred technical solution of the above clothing treatment apparatus, the positioning member includes a positioning post or a positioning hole provided in the cabinet and a positioning hole or a positioning post provided on the cover, and the positioning post or the positioning hole in the cabinet can match with the positioning hole or the positioning post on the cover.

Those skilled in the art can understand that in the preferred technical solutions of the present disclosure, the drum washing machine includes a housing, and a water-containing assembly and a sprinkling assembly arranged in the housing. As compared with the existing technical solution in which the residual water in the water tank cannot be discharged, the water-containing assembly of the present disclosure includes a water tank and a siphon member arranged in the water tank, the siphon member is connected to the sprinkling assembly through a first delivery pipeline, and the sprinkling assembly is configured to perform sprinkling washing on the clothing. When the water tank is completely filled with water or a siphon liquid level is reached, the siphon member can suck out all the water in the water tank by siphoning, so that all the water in the water tank is emptied, which prevents water from remaining in the water tank, thereby preventing the water tank from becoming moldy, deteriorating, and breeding bacteria, and improving the hygienic security of the drum washing machine.

Further, the first outlet of the cabinet is connected to the second sprinkling head through the first delivery pipeline, the second outlet of the cabinet is connected to the first sprinkling head through the second delivery pipeline, and the third outlet of the cabinet is connected to the atomization generator through the third delivery pipeline, so that the water tank can not only supply water to the atomization generator, but also can supply water to the sprinkling assembly. Therefore, the drum washing machine has two clothing washing modes, i.e., atomized air washing and sprinkling washing, so that users can flexibly select the corresponding washing mode according to their own needs to meet various requirements of users and improve the user experience.

Further, the drum washing machine includes a water supply valve, a water delivery channel and a one-way check structure that are arranged in the housing. By connecting the one-way check structure with the water delivery channel and the water tank, when the water supply valve is opened, water can be injected into the water delivery channel and the water tank, and then when the water supply valve is closed, the one-way check structure communicates with the atmosphere so that the water in the water delivery channel and the water tank is sprayed from the atomization generator. The water is converted into small particles of atomized water droplets under the atomization action of the atomization generator, thereby realizing a tender treatment of the clothing by atomized air. The use of this atomized air washing method can treat clothing of special materials such as cashmere, wool, etc., which not only can make the surface of the clothing of this material smoother and softer, but also can quickly remove stains on the clothing without damaging the fiber structures of the clothing, thereby increasing the applicable range of the clothing of the drum washing machine and further improving the user experience.

Fifth Technical Solution

In order to solve the above problems in the prior art, that is, to solve the problems of poor washing effect and very limited applicable range of clothing of existing clothing treatment apparatuses with a washing function, the present disclosure provides a clothing treatment apparatus, and the clothing treatment apparatus includes a clothing treatment drum, a water supply valve, a dispensing device, a water-containing member, an atomization generator and a one-way check structure; in which the dispensing device includes a water delivery channel, the water supply valve is connected to a water inlet end of the water-containing member through the water delivery channel, a water outlet end of the water-containing member is connected to the atomization generator through a first pipeline, and the water outlet end of the water-containing member is also connected to the clothing treatment drum through a second pipeline; an outlet of the atomization generator is arranged facing an inner cavity of the clothing treatment drum, the one-way check structure is connected to the water delivery channel and the water-containing member respectively, and the one-way check structure is arranged to be isolated from the atmosphere when the water supply valve is opened and to communicate with the atmosphere when the water supply valve is closed.

In a preferred technical solution of the above clothing treatment apparatus, a sprinkling head is provided on the clothing treatment drum, and the second pipeline is connected with the sprinkling head.

In a preferred technical solution of the above clothing treatment apparatus, a sprinkling port of the sprinkling head is arranged facing the inner cavity of the clothing treatment drum.

In a preferred technical solution of the above clothing treatment apparatus, the dispensing device further includes a clothing treatment agent dispensing cavity, and the clothing treatment agent dispensing cavity is arranged below the water delivery channel.

In a preferred technical solution of the above clothing treatment apparatus, a position where the one-way check structure is arranged is at a different height from a position where the outlet of the atomization generator is arranged.

In a preferred technical solution of the above clothing treatment apparatus, the position where the one-way check structure is arranged is higher than the position where the outlet of the atomization generator is arranged.

In a preferred technical solution of the above clothing treatment apparatus, the one-way check structure includes a one-way check valve, a third pipeline and a fourth pipeline, the one-way check valve is connected to the water delivery channel through the third pipeline, and the one-way check valve is connected to the water-containing member through the fourth pipeline.

In a preferred technical solution of the above clothing treatment apparatus, the clothing treatment apparatus is a drum washing machine, and the clothing treatment drum is a drum of the drum washing machine.

In a preferred technical solution of the above clothing treatment apparatus, the drum washing machine further includes a window gasket connected to the drum, and the atomization generator is arranged on the window gasket.

In a preferred technical solution of the above clothing treatment apparatus, the atomization generator is arranged on an outer cylinder of the drum.

It can be understood by those skilled in the art that in the preferred technical solutions of the present disclosure, by connecting the one-way check structure with the water delivery channel and the water-containing member, water can be injected into the water delivery channel and the water-containing member when the water supply valve is opened, and then the one-way check structure communicates with the atmosphere when the water supply valve is closed, so that the water in the water delivery channel and the water-containing member is sprayed from the atomization generator, and the water is converted into small particles of atomized water droplets under the atomization action of the atomization generator, thereby realizing a tender treatment of the clothing by atomized air. In addition, other ways of water injection, such as sprinkling, may be provided by connecting the second pipeline to the clothing treatment drum. Specifically, before washing by water, the clothing can be moistened first by atomized water droplets, so that the stains on the surface of the clothing are removed first, preventing the stains on the surface of the clothing from entering the lining of the clothing. After the atomized air washing, water is injected into the clothing treatment drum through the second pipeline. Therefore, less time, water amount, washing liquid and mechanical action can be used to wash the clothing clean in the subsequent washing process so that the washing effect on the clothing is improved and the clothing treatment apparatus is more energy-saving. In addition, the use of this atomized air washing method can treat clothing of special materials such as cashmere, wool, etc., which not only can make the surface of the clothing of this material smoother and softer, but also can quickly remove stains on the clothing without damaging the fiber structures of the clothing, thereby increasing the applicable range of the clothing of the clothing treatment apparatus and further improving the user experience.

Further, the second pipeline is connected to the sprinkling head provided on the clothing treatment drum, so that the clothing treatment apparatus of the present disclosure has at least two clothing washing modes: atomized air washing and sprinkling washing, thus enabling the users to choose the corresponding washing mode flexibly according to their own needs to meet the various requirements of users and improve the user experience.

Further, by setting the position where the one-way check structure is arranged at a different height from the position where the outlet of the atomization generator is arranged, a certain liquid level difference is formed, so that the water in the water delivery channel and the water-containing member can be smoothly sprayed from the outlet of the atomization generator, which makes it easier to perform the atomized air washing of the clothing and improves the user experience.

BRIEF DESCRIPTION OF THE DRAWINGS

Hereinafter, preferred embodiments of the present disclosure will be described with reference to the accompanying drawings and in conjunction with a drum washing machine. In the drawings:

FIG. 5 is a partial structural view showing the principle of a clothing treatment apparatus according to a fifth technical solution of the present disclosure; and FIG. 6 is a partial schematic view showing the structure of a drum washing machine according to the fifth technical solution of the present disclosure.

DETAILED DESCRIPTION

First of all, it should be understood by those skilled in the art that these embodiments are only used to explain the technical principles of the present disclosure, and are not intended to limit the scope of protection of the present disclosure. For example, although the present disclosure is described in conjunction with a drum washing machine, the technical solutions of the present disclosure are obviously applicable to a pulsator washing machine, a washing-drying integrated machine, a clothing care machine, etc., and those skilled in the art may flexibly set the application objects of the technical solutions of the present disclosure. Such adjustments and changes to the application objects do not deviate from the principle of the present disclosure, and should be defined within the scope of protection of the present disclosure.

It should be noted that in the description of the present disclosure, terms indicating directional or positional relationships, such as "in", "above", "below", "inside", "outside" and the like, are based on the directional or positional relationships shown in the accompanying drawings. They are only used for ease of description, and do not indicate or imply that the device or element must have a specific orientation, or be constructed or operated in a specific orientation, and therefore they should not be considered as limitations to the present disclosure.

In addition, it should also be noted that in the description of the present disclosure, unless otherwise clearly specified and defined, terms "arrange", "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

Based on the problem pointed out in the "BACKGROUND OF THE INVENTION" that the production of the washing machine has major limitations if the existing washing machine is equipped with an atomization generator, the present disclosure provides a drum washing machine, which aims to reduce the manufacturing difficulty of the washing machine with the atomization generator and enables the washing machine to make full use of the atomization function of the atomization generator.

Figure 1:
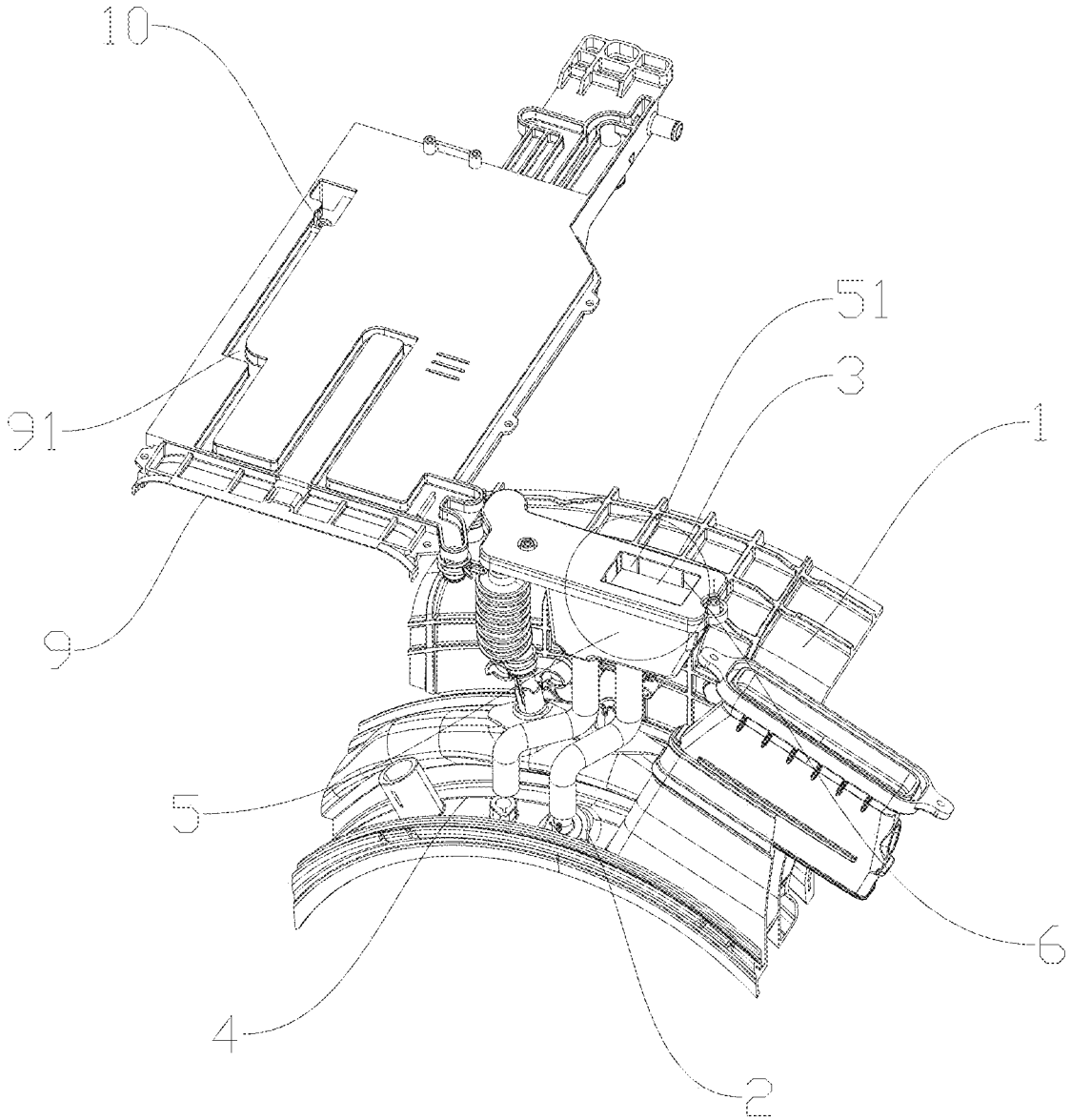
FIG. 1 is a schematic structural view of a drum washing machine according to the first technical solution of the present disclosure.
Figure 2:
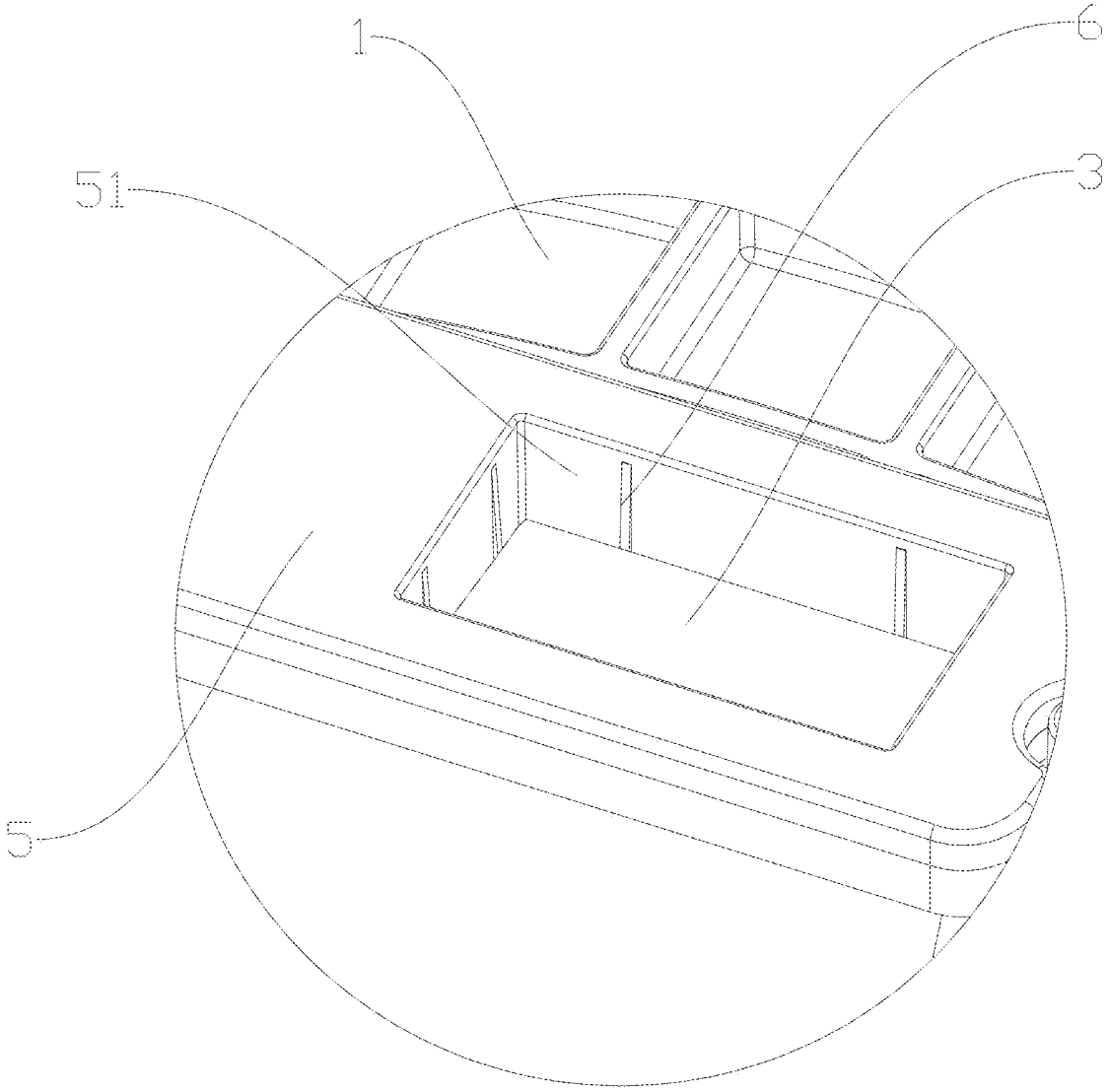
FIG. 2 is a partially enlarged view of FIG. 1.

Specifically, as shown in FIGS. 1 and 2, the drum washing machine of the present disclosure includes a cabinet, a drum 1, a water supply valve, a water-containing member, an atomization generator 2 and a driving board 3; a window gasket 4 is provided between the cabinet and the drum 1, the water supply valve is connected to the atomization generator 2 through the water-containing member, and an outlet of the atomization generator 2 is arranged facing an inner cavity of the drum 1; the atomization generator 2 may be provided either on the window gasket 4 or on the drum 1, as long as it can spray atomized water droplets onto the clothing in an inner cylinder of the drum 1 to perform atomized air washing. The water-containing member is provided with an accommodating structure, the driving board 3 is arranged in the accommodating structure, and the driving board 3 is in communication connection with the atomization generator 2. The water-containing member may be a water tank, or a water box, or a sink on the drum washing machine. Those skilled in the art may flexibly set the specific structure of the water-containing member in practical applications, as long as the water-containing member can store and accommodate water. The accommodating structure may be a recess provided on the water-containing member, or an insertion-fit portion provided on the water-containing member, that is, the driving board 3 may be placed in the recess for installation, or may be inserted into the insertion-fit portion for installation. Those skilled in the art may flexibly set the specific structure of the accommodating structure in practical applications, as long as the driving board 3 can be accommodated by the accommodating structure. In addition, the driving board 3 and the atomization generator 2 may be connected by a wire harness; for example, the wire harness may be a power line. Of course, a Bluetooth module may also be set on both the driving board 3 and the atomization generator 2, and then signals are transmitted via Bluetooth transmission so that the driving board 3 can control the atomization generator 2. The Bluetooth module may also be replaced by other wireless modules, such as a wifi module. Those skilled in the art may flexibly set the communication mode between the driving board 3 and the atomization generator 2 in practical applications, as long as the driving board 3 can control the atomization generator 2. The atomization generator 2 may be an ultrasonic atomization generator or a compressed atomization generator. Those skilled in the art may flexibly set the specific structure of the atomization generator 2 in practical applications, as long as the atomization generator 2 can convert the water in the water-containing member into atomized water droplets so as to perform atomized air washing of the clothing. The technical solution of the present disclosure will be described in detail below by taking the water tank as the water-containing member and the recess provided on an outer surface of the water tank as the accommodating structure.

Figure 3:
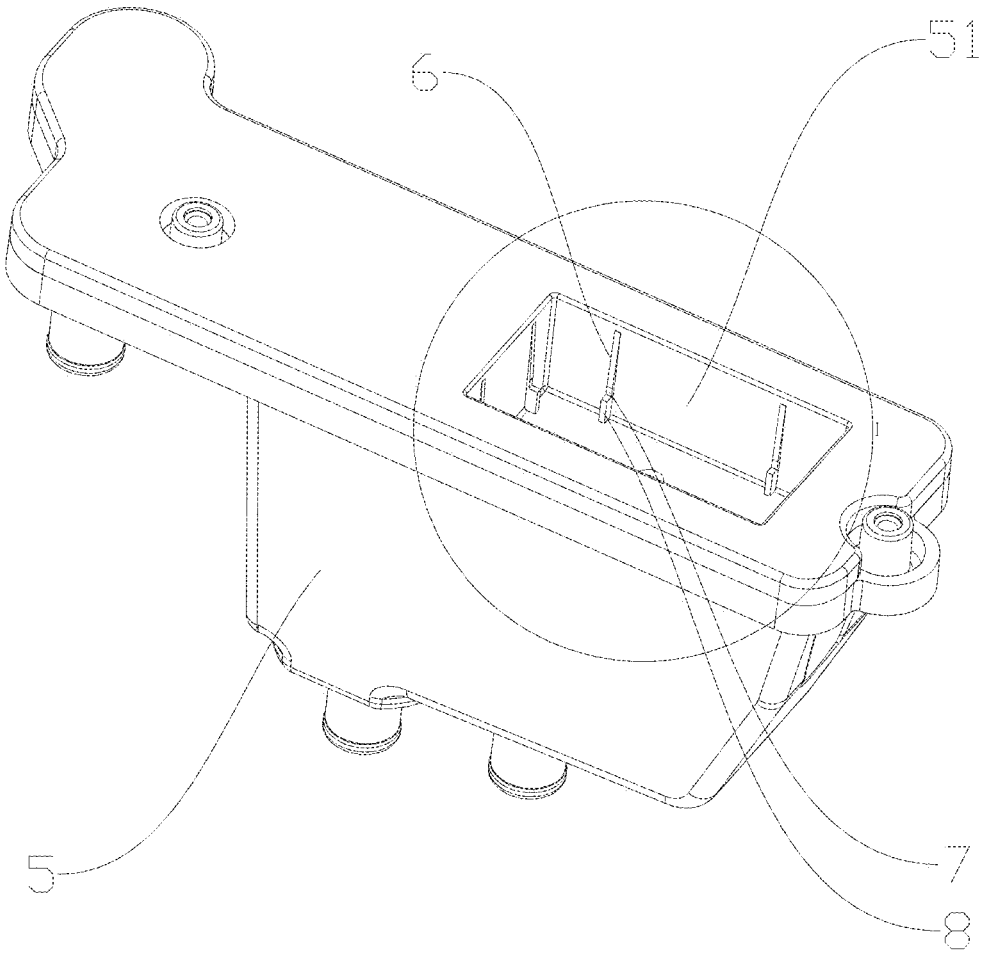
FIG. 3 is a schematic structural view of a water tank of the first technical solution of the present disclosure.
Figure 4:
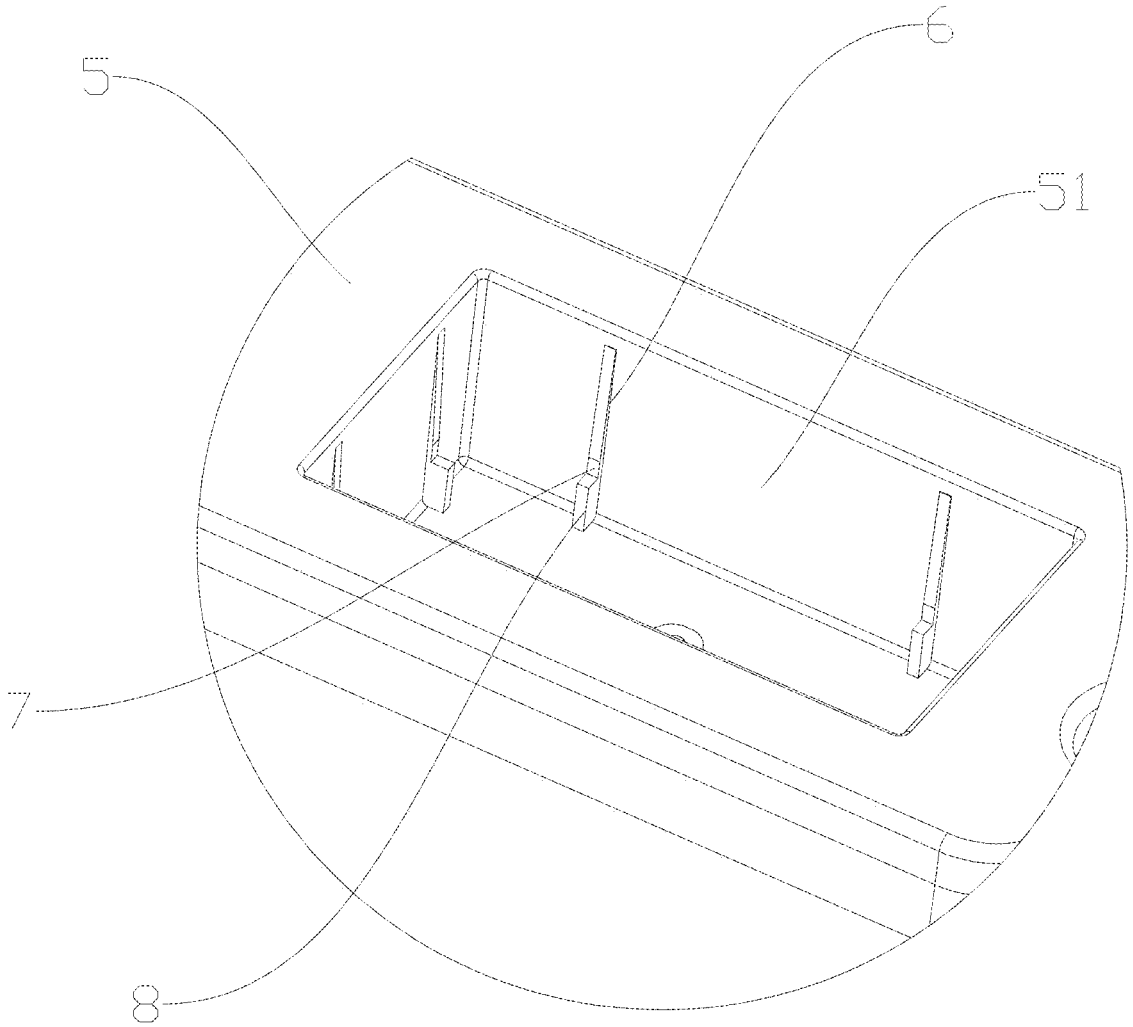
FIG. 4 is a partially enlarged view of FIG. 3.

Preferably, at least one guide structure is provided on an inner side wall of the recess 51 of the water tank 5, and the guide structure is arranged to be able to guide the driving board 3 to an installation position in the recess 51. The installation position of the present disclosure refers to a position where the driving board 3 can be installed in place in the recess 51. The guide structure may be a guide rib, a guide groove, or other structures that can realize the guiding function, as long as the driving board 3 can be guided to be installed in place during the installation of the driving board 3. In addition, the number of the guide structure may be one or plural. In a preferred situation, the guide structure is a guide rib 6, and a thickness of the guide rib 6 gradually increases in an installation direction of the driving board 3. As shown in FIGS. 3 and 4, the thickness of the guide rib 6 gradually increases in the installation direction of the driving board 3 (that is, the direction from a top to a bottom of the recess 51 in FIGS. 3 and 4). With this arrangement, a size of the space formed by the top of the guide rib 6 is larger than a size of the space formed by the bottom of the guide rib 6. In an example in which there are a plurality of guide ribs 6 as shown in FIGS. 3 and 4, the plurality of guide ribs 6 are arranged on an inner wall of the recess 51 in a surrounding manner, and a size of the space formed by the tops of the plurality of guide ribs 6 jointly is slightly larger than an outer contour size of the driving board 3, so that the driving board 3 has a certain fault tolerant range at the top positions of the plurality of guide ribs 6. Therefore, the operator only needs to place the driving board 3 in the recess 51 when installing the driving board 3. As the driving board 3 is pressed and moved downward, the size of the space formed by the plurality of guide ribs 6 jointly is gradually reduced, so as to ensure that the installation of the driving board 3 is corrected. In this way, when the driving board 3 is moved to the bottoms of the plurality of guide ribs 6, it can be accurately moved to the installation position. Of course, it is also possible to provide the guide ribs 6 on only one inner side wall of the recess 51, and no guide ribs 6 are provided on the inner wall of the opposite side. The guide ribs 6 on a single inner wall can also realize a stable guidance of the driving board 3. Such changes to the structure do not deviate from the principle of the present disclosure, and should also be defined within the scope of protection of the present disclosure. In fact, those skilled in the art may flexibly set the number, arrangement positions and distribution of the guide ribs 6 in practical applications, as long as the installation of the driving board 3 can be guided through the change in the thickness of the guide ribs 6.

Preferably, at least one abutment rib 7 is further provided in the recess 51, the abutment ribs 7 correspond to the guide ribs 6 in a one-to-one correspondence, and the abutment ribs 7 are arranged between the guide ribs 6 and an inner bottom wall of the recess 51. In an assembled state, the abutment ribs 7 abut against an outer edge of the driving board 3. Still taking the structure in FIGS. 3 and 4 as an example, the abutment ribs 7 are arranged below the guide ribs 6, and a size of space enclosed by the plurality of abutment ribs 7 jointly exactly matches with the size of the outer edge of the driving board 3, or at least a part of the size of the space enclosed by the plurality of abutment ribs 7 jointly matches with the size of the outer edge of the driving board 3, so that when the driving board 3 is installed in place, the plurality of abutment ribs 7 can abut and limit the driving board 3 from all around, that is, the driving board 3 is stably clamped, so as to realize the fixing of the driving board 3.

Preferably, at least one support rib 8 is further provided in the recess 51, the support ribs 8 correspond to the abutment ribs 7 in a one-to-one correspondence, and the support ribs 8 are arranged between the abutment ribs 7 and the inner bottom wall of the recess 51. In the assembled state, the driving board 3 is supported on the support ribs 8. Still taking the structure in FIGS. 3 and 4 as an example, the support ribs 8 are arranged below the abutment ribs 7, and the plurality of support ribs 8 can jointly support the driving board 3, so that when the driving board 3 is installed in place, the plurality of support ribs 8 can jointly support the bottom of the driving board 3 to realize stable support of the driving board 3.

In the above technical solution, the abutment rib 7 and the guide rib 6 are preferably provided as one piece, and the support rib 8 and the abutment rib 7 are preferably provided as one piece. In a preferred situation, the guide rib 6, the abutment rib 7 and the support rib 8 are all provided as one piece with the recess 51, that is, the guide rib 6, the abutment rib 7 and the support rib 8 are all integrally formed with the water tank 5. This arrangement facilitates unified manufacturing of the water tanks 5 by molding, thereby simplifying the process flow.

In the present disclosure, the drum washing machine further includes a dispensing device 9. The dispensing device 9 includes a clothing treatment agent dispensing cavity and a water box arranged on a top of the clothing treatment agent dispensing cavity. A water delivery channel 91 is formed in the water box. A water inlet end of the water delivery channel 91 is connected to the water supply valve arranged outside of the dispensing device 9, and a water outlet end of the water delivery channel 91 is connected to the atomization generator 2 through the water tank 5; that is, the water outlet end of the water delivery channel 91 may be first connected to the water tank 5 through a pipeline, and then the water tank 5 is connected to the atomization generator 2 through another pipeline. The water tank 5 has a function of accumulating water. A one-way check structure is preferably arranged on the water delivery channel 91. The one-way check structure may be a one-way check valve 10, such as the one-way check valve 10 in the China utility model patent CN207933741U. The principle of the one-way check valve 10 belongs to the prior art, so it will not be described in detail herein. Of course, in the present disclosure, other one-way check structures may also be used. For example, the one-way check structure includes a cylinder, a movable block arranged in the cylinder, and a spring connected between the cylinder and the movable block. The movable block divides an internal cavity of the cylinder into two parts. A top part of the cylinder is provided with an air inlet, a bottom part of the cylinder is provided with a water inlet, and a middle part of the cylinder is provided with an outlet. The spring allows the movable block to move between a top limit position, a middle position and a bottom limit position. When the spring is in a natural state, it enables the movable block to be maintained at the bottom limit position. At this time, the air inlet communicates with the outlet, and the water inlet is isolated from the outlet by the movable block, so as to realize the communication between the one-way check structure and the atmosphere. When water inflows from the water inlet, the water pressure moves the movable block to the top limit position against the force of the spring, so that the water inlet communicates with the outlet, and that the air inlet is isolated from the outlet by the movable block. Therefore, the one-way check structure allows water to pass through and is isolated from the atmosphere. It should be noted that the above-mentioned top part and bottom part are defined relative to the cylinder, and they do not constitute restrictions to the specific direction and specific position of arranging the one-way check structure. Alternatively, the one-way check structure may also be a plug structure. Specifically, an opening is provided on the water delivery channel 91, and a plug is provided at the opening. When water inflows from the water supply valve, the opening is closed by the plug, and when the water supply valve is closed, the plug is removed and the opening communicates with the atmosphere, so that the water in the water tank 5 is sprayed from the outlet of the atomization generator 2. Those skilled in the art may flexibly set the specific structure of the one-way check structure in practical applications, as long as the one-way check structure can be isolated from the atmosphere when the water supply valve is opened and can communicate with the atmosphere when the water supply valve is closed.

It should be noted that by using the one-way check structure, the present disclosure enables the atomization generator 2 to smoothly generate atomized water droplets. This is because when the water supply valve is always open, it is very difficult for the atomization generator 2 to form atomized water droplets under the action of water pressure. Therefore, the water supply valve can be opened to accumulate water in the water tank 5, and then the water supply valve can be closed. At this time, the water in the water tank 5 can be sprayed onto the clothing in the form of atomized water droplets from the atomization generator 2 according to the principle of atmospheric communication, so as to ensure that the atomization generator 2 can perform atomized air washing of the clothing in the drum 1. Of course, the one-way check structure of the present disclosure may also be directly arranged on the water tank 5. The simple change of the position of the one-way check structure does not deviate from the principle of the present disclosure, and should be defined within the scope of protection of the present disclosure. In practical applications, a position where the outlet of the atomization generator 2 is arranged may be set lower than a position where the one-way check structure is arranged, so as to facilitate the water in the water tank 5 to be sprayed from the atomization generator 2.

Preferred embodiments of the present disclosure will be described below with reference to the accompanying drawings. It should be understood by those skilled in the art that these embodiments are only used to explain the technical principles of the present disclosure, and are not intended to limit the scope of protection of the present disclosure.

It should be noted that in the description of the present disclosure, terms indicating directional or positional relationships, such as "in", "above", "below", "inside", "outside" and the like, are based on the directional or positional relationships shown in the accompanying drawings. They are only used for ease of description, and do not indicate or imply that the device or element must have a specific orientation, or be constructed or operated in a specific orientation, and therefore they should not be considered as limitations to the present disclosure. In addition, terms "first", "second", "third" and "fourth" are only used for descriptive purposes, and should not be understood as indicating or implying relative importance.

In addition, it should also be noted that in the description of the present disclosure, unless otherwise clearly specified and defined, terms "arrange", "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

Based on the problems pointed out in the "BACKGROUND OF THE INVENTION" that existing clothing treatment apparatuses with a washing function have a poor washing effect and very limited applicable range of clothing, the present disclosure provides a clothing treatment apparatus, aiming at improving the washing effect of the clothing treatment apparatuses with the washing function on the clothing, increasing the applicable range of the clothing, meeting user's requirements on use, and thereby improving the user experience.

Specifically, as shown in FIG. 5, the clothing treatment apparatus of the present disclosure includes a clothing treatment drum, a water supply valve 1, a dispensing device 2, a water-containing member, an atomization generator 3, and a one-way check structure. The dispensing device 2 includes a water delivery channel 21, the water supply valve 1 is connected to a water inlet end of the water-containing member through the water delivery channel 21, a water outlet end of the water-containing member is connected to the atomization generator 3 through a first pipeline 9, and the water outlet end of the water-containing member is also connected to the clothing treatment drum through a second pipeline 10. An outlet of the atomization generator 3 is arranged facing an inner cavity of the clothing treatment drum. The one-way check structure is connected with the water delivery channel 21 and the water-containing member respectively, and the one-way check structure is arranged to be isolated from the atmosphere when the water supply valve 1 is opened and to communicate with the atmosphere when the water supply valve 1 is closed. The water-containing member may be a water tank, or a water box, or a sink on the clothing treatment apparatus. Those skilled in the art may flexibly set the specific structure of the water-containing member in practical applications, as long as the water-containing member can store and accommodate water. The atomization generator 3 may be an ultrasonic atomization generator or a compressed atomization generator. Those skilled in the art may flexibly set the specific structure of the atomization generator 3 in practical applications, as long as the atomization generator 3 can convert the water in the water delivery channel 21 and the water-containing member into atomized water droplets when the one-way check structure communicates with the atmosphere so as to perform atomized air washing of the clothing. In addition, a combined structure of a one-way check valve 8 and pipelines may be used as the one-way check structure, in which the one-way check valve 8 may be the one-way check valve 8 in the China utility model patent CN207933741U. The principle of the one-way check valve 8 belongs to the prior art, so it will not be described in detail herein. Of course, in the present disclosure, other combined structures of a one-way check structure and pipelines may also be used. For example, the one-way check structure includes a cylinder, a movable block arranged in the cylinder, and a spring connected between the cylinder and the movable block. The movable block divides an internal cavity of the cylinder into two parts. A top part of the cylinder is provided with an air inlet, a bottom part of the cylinder is provided with a water inlet, and a middle part of the cylinder is provided with an outlet. The spring allows the movable block to move between a top limit position, a middle position and a bottom limit position. When the spring is in a natural state, it enables the movable block to be maintained at the bottom limit position. At this time, the air inlet communicates with the outlet, and the water inlet is isolated from the outlet by the movable block, so as to realize the communication between the one-way check structure and the atmosphere. When water inflows from the water inlet, the water pressure moves the movable block to the top limit position against the force of the spring, so that the water inlet communicates with the outlet, and that the air inlet is isolated from the outlet by the movable block. Therefore, the one-way check structure allows water to pass through and is isolated from the atmosphere. It should be noted that the above-mentioned top part and bottom part are defined relative to the cylinder, and they do not constitute restrictions to the specific direction of arranging the one-way check structure. Alternatively, the one-way check structure may also be a combined structure of a plug and pipelines. Specifically, the water delivery channel 21 and the water-containing member are connected by a connection pipe, an opening is provided at the highest point of the connection pipe, and a plug is provided at the opening. When water inflows from the water supply valve 1, the opening is closed by the plug, and when the water supply valve 1 is closed, the plug is removed and the opening communicates with the atmosphere, so that the water in the water delivery channel 21 and the water-containing member is sprayed from the outlet of the atomization generator 3. Those skilled in the art may flexibly set the specific structure of the one-way check structure in practical applications, as long as the one-way check structure can be isolated from the atmosphere when the water supply valve 1 is opened and can communicate with the atmosphere when the water supply valve 1 is closed. In the present disclosure, the first pipeline 9 and the second pipeline 10 may be connected to the water delivery channel 21 through the same water outlet end of the water delivery channel 21, or they may also be connected to the water delivery channel 21 through different water outlet ends of the water delivery channel 21 respectively. Such changes to the structure do not deviate from the technical solutions of the present disclosure, and should be defined within the scope of protection of the present disclosure.

It should be noted that by using the one-way check structure, the present disclosure enables the atomization generator 3 to smoothly generate atomized water droplets. This is because when the water supply valve 1 is always open, it is very difficult for the atomization generator 3 to form atomized water droplets under the action of water pressure. Therefore, the water supply valve 1 can be opened to accumulate water in the water delivery channel 21 and the water-containing member, and then the water supply valve 1 can be closed. At this time, the water in the water delivery channel 21 and the water-containing member can be sprayed onto the clothing in the form of atomized water droplets from the atomization generator 3 according to the principle of atmospheric communication, so as to ensure that the atomization generator 3 can perform atomized air washing of the clothing. If it is required to inject a large amount of water into the clothing treatment drum, the atomization generator 3 is closed at this time so as to keep the water supply valve 1 always open and ensure that the second pipeline 10 is in a communicated state, thereby achieving continuous water injection into the clothing treatment drum. The second pipeline 10 can be directly connected to a water injection port or sprinkling structure on the clothing treatment drum.

In addition, it should also be noted that the clothing treatment apparatus of the present disclosure may be a drum washing machine, a pulsator washing machine, a washing-drying integrated machine, a clothing care machine, etc., and those skilled in the art may flexibly set the application objects of the technical solutions of the present disclosure. Such adjustments and changes to the application objects do not deviate from the principle of the present disclosure, and should be defined within the scope of protection of the present disclosure. The technical solutions of the present disclosure will be further explained below in conjunction with a drum washing machine.

Specifically, as shown in FIGS. 5 and 6, the drum washing machine of the present disclosure includes a cabinet, a drum 4 arranged in the cabinet, and a window gasket 5 connected between an outer cylinder of the drum 4 and the cabinet. The atomization generator 3 is preferably arranged on the window gasket 5, and an outlet of the atomization generator 3 is obliquely arranged facing an inner cavity of the drum 4 (of course, other directions of arrangement are also possible). Alternatively, the atomization generator 3 may also be provided on the outer cylinder of the drum 4, as long as it can spray atomized water droplets onto the clothing in an inner cylinder of the drum 4 to perform atomized air washing. A sprinkling head 7 is provided on the drum 4 or on the window gasket 5, and an outlet of the sprinkling head 7 is also arranged facing the inner cavity of the drum 4. The sprinkling head 7 is mainly configured to sprinkle water into the drum 4. A control valve may be selectively installed on the second pipeline 10, and the control valve can control on and off of the second pipeline 10. In addition, the drum washing machine also includes a dispensing device 2 arranged on the cabinet. The dispensing device 2 includes a clothing treatment agent dispensing cavity and a water box arranged on a top of the clothing treatment agent dispensing cavity. The water delivery channel 21 is formed in the water box. A water inlet end of the water delivery channel 21 is connected to the water supply valve 1 arranged outside of the dispensing device 2, and a water outlet end of the water delivery channel 21 is connected to a water tank 6 through a pipeline. The water tank 6 is connected to the atomization generator 3 through the first pipeline 9, and is also connected to the drum 4 through the second pipeline 10. The water tank 6 has a function of accumulating water. The one-way check valve 8 is arranged outside of the water delivery channel 21 and the water tank 6, is connected to the water delivery channel 21 through a third pipeline 11, and is also connected to the water tank 6 through a fourth pipeline 12 (this part of the structure is not shown in FIG. 6).

Preferably, the position where the one-way check valve 8 is arranged is at a different height from the position where the outlet of the atomization generator 3 is arranged, that is, when the one-way check valve 8 communicates with the atmosphere, a certain liquid level difference can be formed between the one-way check valve 8 and the outlet of the atomization generator 3, so that the water accumulated in the water delivery channel 21 and the water tank 6 can be sprayed onto the clothing more easily in the form of atomized water droplets through the atomization generator 3. Since the position where the dispensing device 2 is arranged is generally higher than the position where the drum 4 is arranged in the drum washing machine, it is more preferable to set the position where the one-way check valve 8 is arranged to be higher than the position where the outlet of the atomization generator 3 is arranged, thereby making full use of the original structure of the drum washing machine.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A clothing treatment apparatus, comprising: a clothing treatment drum, wherein the clothing treatment apparatus also comprises a water supply valve, a water tank, an atomization generator and a driving board connected to the atomization generator through a wire harness and for controlling the atomization generator; the water supply valve is connected to the atomization generator through the water tank, an outlet of the atomization generator is arranged facing an inner cavity of the clothing treatment drum, the water tank is provided with a recess formed on an outer surface of the water tank, and the driving board is arranged in the recess.

2. The clothing treatment apparatus according to claim 1, wherein at least one guide structure is arranged on an inner side wall of the recess, and the guide structure is arranged to be able to guide the driving board to an installation position in the recess.

3. The clothing treatment apparatus according to claim 2, wherein the guide structure is a guide rib, and a thickness of the guide rib gradually increases in an installation direction of the driving board.

4. The clothing treatment apparatus according to claim 3, wherein at least one abutment rib is further arranged in the recess, the abutment ribs correspond to the guide ribs in a one-to-one correspondence, and the abutment ribs are arranged between the guide ribs and an inner bottom wall of the recess; in an assembled state, the abutment ribs abut against an outer edge of the driving board.

5. The clothing treatment apparatus according to claim 4, wherein the abutment rib and the guide rib are provided as one piece.

6. The clothing treatment apparatus according to claim 4, wherein at least one support rib is further arranged in the recess, the support ribs correspond to the abutment ribs in a one-to-one correspondence, and the support ribs are arranged between the abutment ribs and the inner bottom wall of the recess; in the assembled state, the driving board is supported on the support ribs.

7. The clothing treatment apparatus according to claim 6, wherein the support rib and the abutment rib are provided as one piece.

8. The clothing treatment apparatus according to claim 1, further comprising a dispensing device, wherein the dispensing device comprises a water delivery channel, and the water supply valve is connected to the water tank through the water delivery channel; the water delivery channel is provided with a one-way check structure, and the one-way check structure is arranged to be isolated from the atmosphere when the water supply valve is opened and to communicate with the atmosphere when the water supply valve is closed.

9. The clothing treatment apparatus according to claim 1, wherein the clothing treatment apparatus is a drum washing machine, and the clothing treatment drum is a drum of the drum washing machine; and wherein the drum washing machine further comprises a window gasket connected to the drum, and the atomization generator is arranged on the window gasket.

* * * * *